US011746567B2

(12) United States Patent
Kindstrand et al.

(10) Patent No.: US 11,746,567 B2
(45) Date of Patent: Sep. 5, 2023

(54) HOOP LOCK WITH DUAL LOCKING

(71) Applicant: Schlage Lock Company LLC, Carmel, IN (US)

(72) Inventors: Daniel H. Kindstrand, Tucson, AZ (US); Manjunatha Ramakrishna, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 511 days.

(21) Appl. No.: 16/800,536

(22) Filed: Feb. 25, 2020

(65) Prior Publication Data

US 2020/0208441 A1 Jul. 2, 2020

Related U.S. Application Data

(62) Division of application No. 14/738,019, filed on Jun. 12, 2015, now Pat. No. 10,570,647.

(60) Provisional application No. 62/011,470, filed on Jun. 12, 2014.

(51) Int. Cl.

| | |
|---|---|
| ***E05B 67/06*** | (2006.01) |
| *E05B 67/22* | (2006.01) |
| *E05B 17/00* | (2006.01) |

(52) U.S. Cl.

CPC ..... *E05B 67/063* (2013.01); *E05B 17/002* (2013.01); *E05B 67/06* (2013.01); *E05B 67/22* (2013.01); *Y10T 70/491* (2015.04)

(58) Field of Classification Search

CPC ..... E05B 67/063; E05B 17/00; E05B 17/002; E05B 67/00; E05B 67/06; E05B 67/22; Y10T 70/491

USPC ..... 70/38 A–38 C, 39, 49, 52, 53, 233

See application file for complete search history.

(56) References Cited

U.S. PATENT DOCUMENTS

| | | | | |
|---|---|---|---|---|
| 348,521 | A | 8/1886 | Hillebrand | |
| 1,420,578 | A | 6/1922 | Reichstein | |
| 1,580,574 | A | 4/1926 | Segal | |
| 1,886,912 | A * | 11/1932 | Shaw | E05B 67/24 70/52 |
| 2,282,983 | A * | 5/1942 | Lach | E05B 67/24 70/52 |
| 2,433,114 | A | 12/1947 | Gray | |
| 2,726,531 | A * | 12/1955 | Vile | E05B 67/24 70/52 |

(Continued)

FOREIGN PATENT DOCUMENTS

| | | | |
|---|---|---|---|
| CN | 102140867 | A | 8/2011 |
| CN | 103867038 | A | 6/2014 |

(Continued)

OTHER PUBLICATIONS

Canadian Office Action, Canadian Intellectual Property Office, Canadian Patent Application No. 3,080,378, dated Jun. 9, 2021, 3 pages.

(Continued)

*Primary Examiner* — Suzanne L Barrett

(74) *Attorney, Agent, or Firm* — Taft Stettinius & Hollister LLP

(57) ABSTRACT

A hoop lock including a shackle, a crossbar, and a locking assembly operable to secure the shackle to the crossbar. The shackle may include a straight foot and a bent foot, and the locking assembly may engage the straight foot and the bent foot to secure the shackle to the crossbar.

22 Claims, 7 Drawing Sheets

(56) References Cited

U.S. PATENT DOCUMENTS

| | | | | |
|---|---|---|---|---|
| 3,349,584 | A | 10/1967 | Russell et al. | |
| 3,882,699 | A | 5/1975 | Flack et al. | |
| 4,028,916 | A | 6/1977 | Pender | |
| 4,112,715 | A | 9/1978 | Uyeda | |
| 4,241,594 | A | 12/1980 | Miller et al. | |
| 4,290,280 | A | 9/1981 | Yun | |
| 4,345,447 | A | 8/1982 | Keung et al. | |
| 4,464,915 | A | 8/1984 | Moshe et al. | |
| 4,551,997 | A | 11/1985 | Huang | |
| 4,730,470 | A | 3/1988 | Zane et al. | |
| 4,881,387 | A | 11/1989 | Kortenbrede | |
| 4,920,772 | A | 5/1990 | Denison | |
| 5,010,746 | A | 4/1991 | Zane et al. | |
| 5,092,142 | A | 3/1992 | Zane et al. | |
| 5,142,888 | A | 9/1992 | Ling | |
| 5,186,029 | A | 2/1993 | Myers | |
| 5,189,893 | A | 3/1993 | Kortenbrede | |
| 5,230,231 | A * | 7/1993 | Liou | E05B 67/24 70/52 |
| 5,253,496 | A | 10/1993 | Wang | |
| 5,331,830 | A | 7/1994 | Su | |
| 5,372,019 | A | 12/1994 | Hsiao | |
| 5,394,712 | A | 3/1995 | Chou | |
| 5,398,529 | A | 3/1995 | Goldman et al. | |
| 5,406,812 | A | 4/1995 | Jaw | |
| 5,417,092 | A | 5/1995 | Iu | |
| 5,488,845 | A | 2/1996 | Hsieh | |
| 5,706,679 | A | 1/1998 | Zane et al. | |
| 5,787,736 | A | 8/1998 | Ling | |
| 5,819,560 | A | 10/1998 | Grahovec et al. | |
| 5,823,021 | A | 10/1998 | Chang | |
| 5,832,762 | A | 11/1998 | McDaid | |
| 5,839,302 | A | 11/1998 | Chu | |
| 5,931,030 | A | 8/1999 | Chen | |
| 5,950,461 | A | 9/1999 | Tsai | |
| 5,987,940 | A | 11/1999 | Chang | |
| 6,101,852 | A | 8/2000 | Steinbach | |
| 6,212,922 | B1 | 4/2001 | Miao | |
| 6,341,509 | B1 | 1/2002 | McDaid | |
| 6,666,051 | B1 | 12/2003 | Li | |
| 6,694,781 | B1 | 2/2004 | Li | |
| 6,718,802 | B2 | 4/2004 | Vito | |
| 6,725,692 | B2 | 4/2004 | Weinraub | |
| 6,761,051 | B1 * | 7/2004 | Tsai | E05B 47/0012 70/279.1 |
| 6,923,027 | B1 | 8/2005 | Kuo | |
| 7,121,121 | B2 | 10/2006 | Wyers | |
| 7,948,359 | B2 | 5/2011 | Marcelle et al. | |
| 8,127,577 | B2 | 3/2012 | Buhl et al. | |
| 9,163,431 | B2 | 10/2015 | Young et al. | |
| 10,557,288 | B2 * | 2/2020 | Ramakrishna | E05B 67/063 |
| 10,570,647 | B2 * | 2/2020 | Kindstrand | E05B 67/063 |
| 2002/0053226 | A1 | 5/2002 | McDaid | |
| 2005/0262904 | A1 | 12/2005 | Ling et al. | |
| 2009/0282876 | A1 | 11/2009 | Zuraski et al. | |
| 2012/0318028 | A1 | 12/2012 | Hahn | |

FOREIGN PATENT DOCUMENTS

| | | | |
|---|---|---|---|
| DE | 3126035 | A1 | 1/1983 |
| DE | 4312033 | A1 | 11/1993 |
| DE | 29618579 | U1 | 12/1996 |
| DE | 19532383 | A1 | 3/1997 |
| DE | 19638188 | A1 | 3/1998 |
| DE | 19706560 | A1 | 7/1998 |
| DE | 19937128 | A1 | 2/2001 |
| DE | 202013103393 | U1 | 8/2013 |
| EP | 0476229 | A1 | 3/1992 |
| EP | 2020474 | A2 | 2/2009 |
| EP | 2154055 | A2 | 2/2010 |
| GB | 2312468 | A | 10/1997 |
| JP | 2001090414 | A | 4/2001 |
| WO | 9637677 | A1 | 11/1996 |

OTHER PUBLICATIONS

Extended European Search Report; European Patent Office; European Patent Application No. 20154153.8; dated Jul. 15, 2020; 14 pages.

International Search Report; International Searching Authority; International PCT Application No. PCT/JS2015/035575; Nov. 4, 2015; 4 pages.

Written Opinion; International Searching Authority; International PCT Application No. PCT/US2015/035575; dated Nov. 4, 2015; 6 pages.

Canadian Office Action; Canadian Intellectual Property Office; Canadian Patent Application No. 2,954,358; dated Mar. 19, 2019; 3 pages.

Canadian Office Action; Canadian Intellectual Property Office; Canadian Patent Application No. 2,954,358; dated Jul. 30, 2018; 3 pages.

Chinese Search Report; State Intellectual Property Office; Peoples Republic of China; Chinese Patent Application No. 201580038154.2; dated Jun. 14, 2018; 3 pages.

Chinese Office Action; State Intellectual Property Office; Peoples Republic of China; Chinese Patent Application No. 201580038154.2; dated Jun. 28, 2018; 9 pages.

Extended Supplementary European Search Report; European Patent Office; European Patent Application No. 15807117.5; dated Jan. 2, 2018; 5 pages.

Extended Supplementary European Search Report; European Patent Office; European Patent Application No. 18215734.7; dated Apr. 23, 2019; 7 pages.

Canadian Office Action; Canadian Intellectual Property Office; Canadian Patent Application No. 3,080,378; dated Apr. 19, 2022; 3 pages.

* cited by examiner

HOOP LOCK WITH DUAL LOCKING

CROSS-REFERENCE TO RELATED APPLICATIONS

The present application is a divisional of U.S. patent application Ser. No. 14/738,019 filed Jun. 12, 2015 and issued as U.S. Pat. No. 10,570,647, which claims the benefit of U.S. Provisional Patent Application No. 62/011,470 filed on Jun. 12, 2014, the contents of each application hereby incorporated herein by reference in their entirety.

TECHNICAL FIELD

The present invention generally relates to shackle locks, and more particularly, but not exclusively, to locks having a removable shackle.

BACKGROUND

Shackle-type locks are commonly used to secure a portable object such as a bicycle to a stationary object such as a rack. Such locks are sometimes referred to as U-locks, hoop locks, or bicycle locks. Some locks of this type have certain limitations, such as those relating to resistance to tampering, attack, and high pull forces. Therefore, a need remains for further improvements in this technological field.

SUMMARY

An exemplary hoop lock includes a shackle, a crossbar, and a locking assembly operable to secure the shackle to the crossbar. The shackle may include a straight foot and a bent foot, and the locking assembly may engage the straight foot and the bent foot to secure the shackle to the crossbar. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
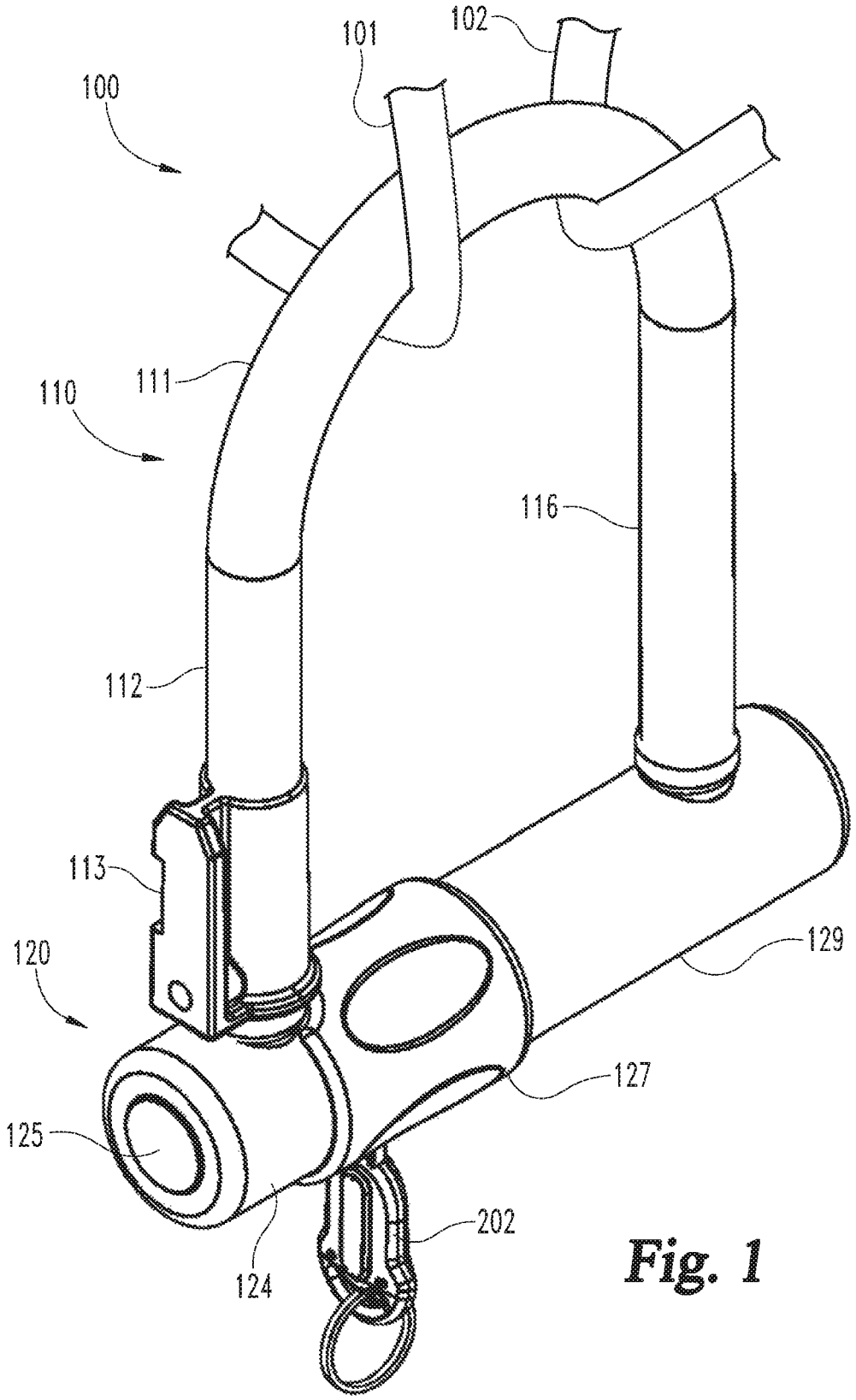
FIG. 1 is an isometric view of a lock according to one embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Figure 2:
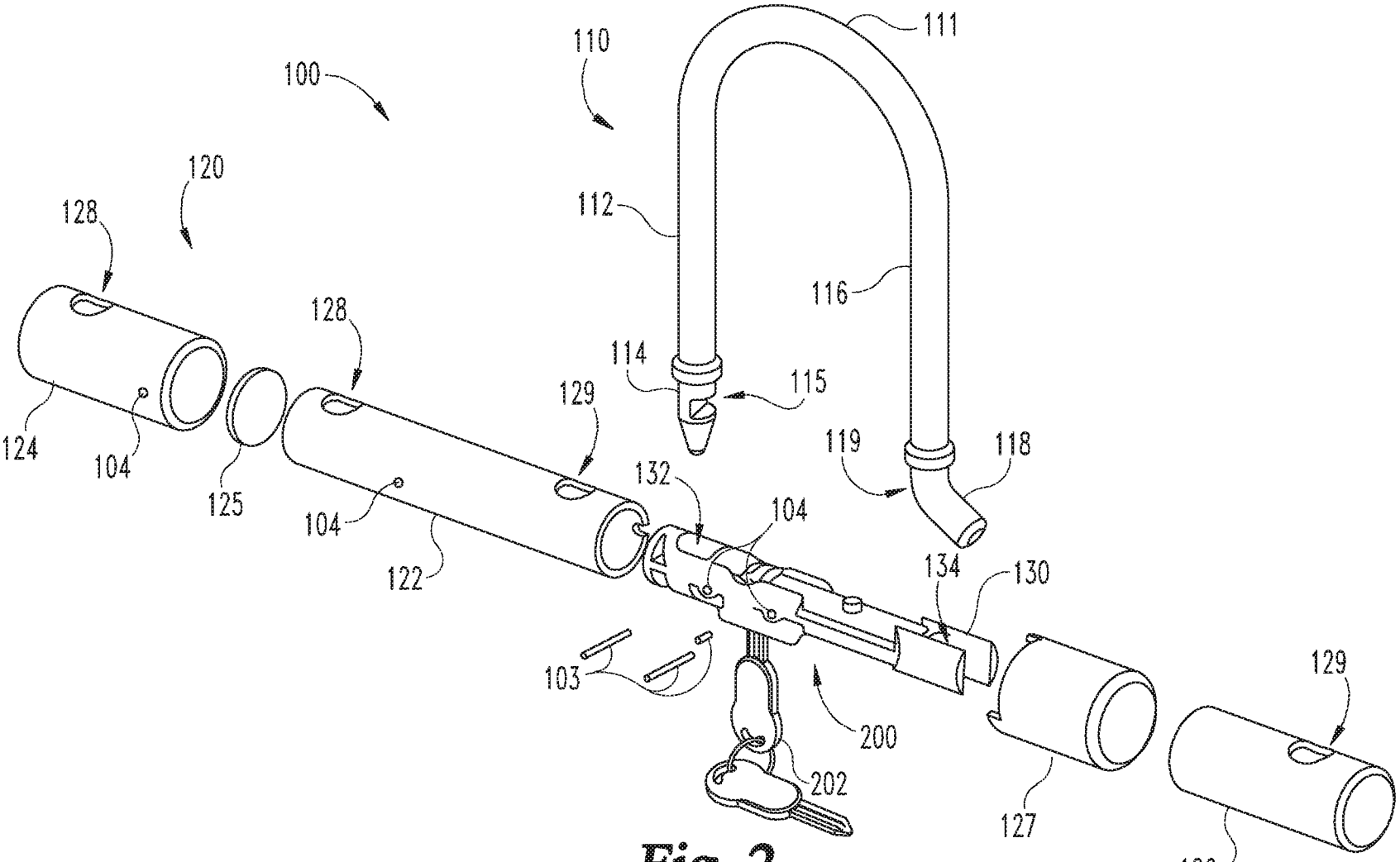
FIG. 2 is an exploded assembly view of the lock.

With reference to FIGS. 1 and 2, an exemplary lock 100 according to one embodiment includes a hoop or shackle 110 and a barrel or crossbar 120, which includes a housing 130 and a locking assembly 200. As described in further detail below, the shackle 110 and crossbar 120 are separable, and the locking assembly 200 is operable to selectively secure the crossbar 120 to the shackle 110. The lock 100 may be used to secure a first object 101 to a second object 102, for example to prevent theft or unauthorized separation of the objects 101, 102.

The shackle 110 includes an arcuate connecting portion 111 connecting a first leg 112 having a first foot 114 to a second leg 116 having a second foot 118. In the illustrated form, the legs 112, 116 are substantially parallel to one another, and the connecting portion 111 defines a semicircle, such that the shackle 110 is substantially U-shaped. It is also contemplated that shackle 110 may be of another shape. By way of example, the connecting portion 111 may be substantially rectilinear.

The first foot 114 is substantially coaxial with the first leg 112, while the second foot 118 is angularly offset with respect to the second leg 116. As such, the first foot 114 may be considered a straight foot, and the second foot 118 may be considered an angled or bent foot. The first foot 114 includes a first notch 115, and the second foot 118 includes a second notch 119. As described in further detail below, the notches 115, 119 are engageable with the locking assembly 200 to selectively couple the shackle 110 to the crossbar 120. The shackle 110 may further include bumpers 117 adjacent the feet 114, 118.

The crossbar 120 includes a substantially cylindrical tube 122, and a sleeve 124 operable to receive a first end portion of the tube 122 such that an end cap 125 is retained on the first end of the tube 122. The crossbar 120 also includes a tube cover 126 operable to receive a second end portion of the tube 122, and may further include a dust cover 127. The tube 122 and sleeve 124 each include a first or proximal opening 128 operable to receive the first foot 114, and the tube 122 and tube cover 126 each include a second or distal opening 129 operable to receive the second foot 118. When assembled, the housing 130 and locking assembly 200 are retained within the tube 122 between the end cap 125 and the tube cover 126. During assembly, fasteners such as assembly pins 103 may be passed through openings 104 in the various elements of the crossbar 120 to secure the elements in their proper positions.

Figure 3:
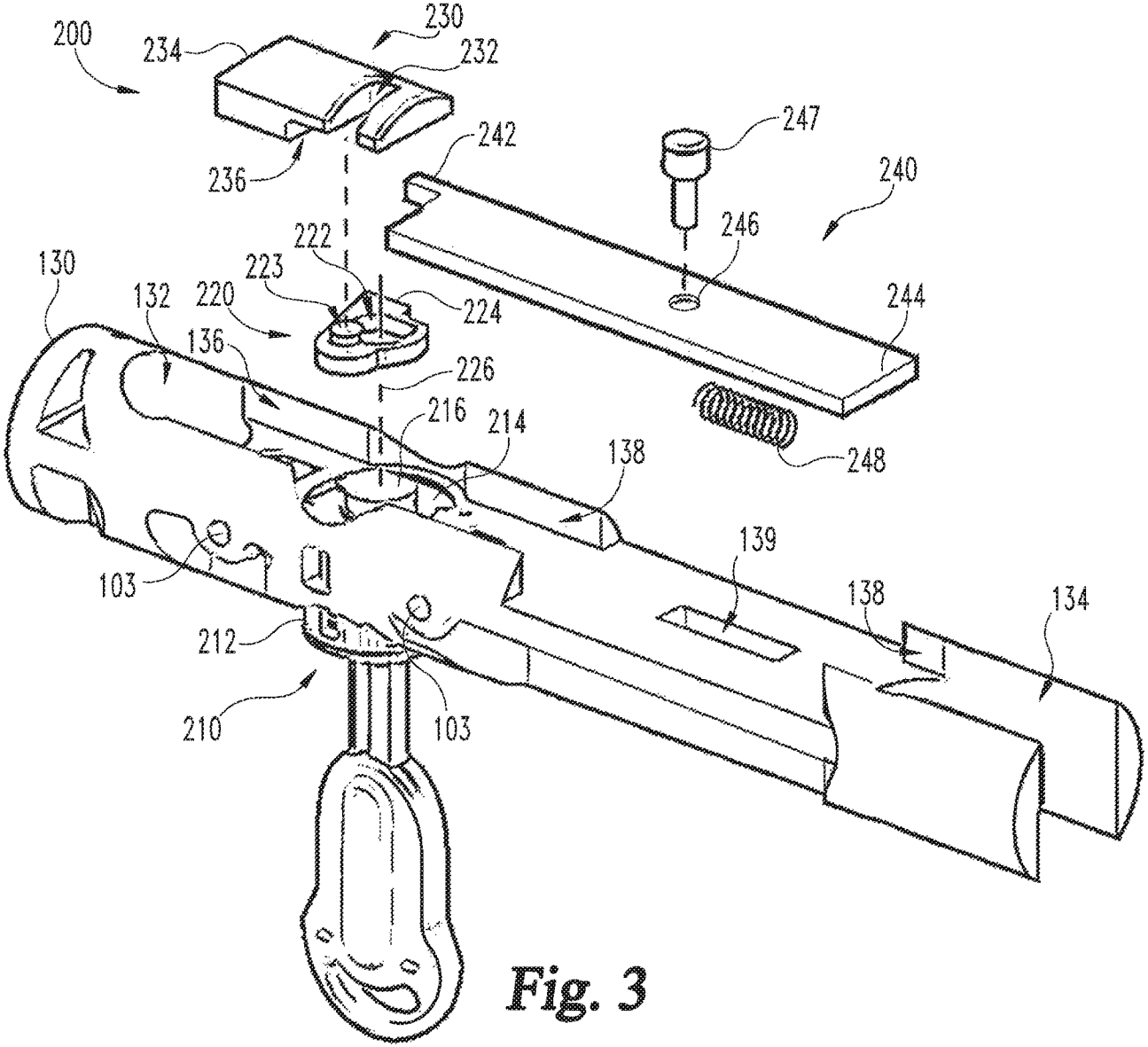
FIG. 3 is an exploded assembly view of a locking subassembly according to one embodiment.

With additional reference to FIG. 3, the locking assembly 200 includes a lock cylinder 210, a cam 220 connected to the lock cylinder 210, a primary bolt 230 operable to engage the first or proximal foot 114, and a secondary bolt 240 operable to engage the second or distal foot 118. The housing 130 may include channels 136, 138 which receive at least a portion of the primary and secondary bolts 230, 240 to constrain motion of the bolts 230, 240 to a path substantially parallel to a longitudinal axis of the crossbar 120. As described in further detail below, the bolts 230, 240 are engaged with the cam 220 such that the bolts 230, 240 extend or retract in response to rotation of the cam 220.

The lock cylinder 210 includes a shell 212 coupled to the housing 130, and a spindle 214 which is rotatable with respect to the shell 212 upon insertion of a proper key 202. While the illustrated lock cylinder 210 is a rotary disc tumbler lock, it is also contemplated that other forms of lock cylinders, including those which utilize sliding wafers and/or pin tumblers, may be utilized. When assembled, the lock cylinder 210 is positioned in the housing 130 such that the keyway 215 thereof is aligned with openings 123 in the tube 122 and sleeve 124. The spindle 114 also includes a spindle extension 216 configured to engage the cam 220, such that when the proper key 202 is inserted and rotated, the spindle extension 216 rotates the cam 220.

While other configurations are contemplated, in the illustrated form, the lock cylinder 210 is offset from the longitudinal center of the crossbar 120, is positioned between the feet 114, 118, and is closer to the primary foot 114 than to the secondary foot 118. As such, the opening 123 in the tube 122 is also offset from the center of the crossbar 120, and is positioned longitudinally between and radially across from the openings 128, 129. Additionally, the keyway 215 is substantially parallel to a central axis of the opening 128, such that when the shackle 110 is coupled to the crossbar 120 and the key 202 is inserted, the shank of the key 202 is substantially parallel to the legs 112, 116. In embodiments which employ the dust cover 127, the dust cover 127 may also include an opening 123 which is selectively alignable with the keyway 215, such that when the dust cover opening 123 is not aligned with the keyway 215, dirt and other contaminants are blocked from entering the keyway 215.

The cam 220 is configured to translate rotary motion of the spindle extension 216 to linear motion of the bolts 230, 240, and is rotationally coupled to the extension 216. For example, the cam 220 may include an opening 222 having a geometry corresponding to that of the extension 216. The cam 220 includes a projection or protrusion 223 operable to engage the primary bolt 230, and a cam arm 224 operable to engage the secondary bolt 240. The illustrated protrusion 223 is offset from a rotational axis 226 of the cam 220, and is provided in the form of an axial protrusion. In other words, the protrusion 220 extends in the direction of the rotational axis 226. Additionally, the illustrated cam arm 224 is a radial arm which extends away from the rotational axis 226 at least partially in the radial direction. As described in further detail below, rotation of the cam 220 in a first direction causes the bolts 230, 240 to retract toward unlocking positions, and rotation of the cam 220 in a second direction causes the bolts 230, 240 to extend toward locking positions.

The primary bolt 230 includes a channel 232 sized and configured to receive the cam protrusion 223, and an engagement end 234 operable to engage the first foot 114. More specifically, the engagement end 234 is configured to be received in the first notch 115, and may have a thickness corresponding to a width of the first notch 115. The primary bolt 230 may further include an undercut 236 having a depth corresponding to a width of the secondary bolt 240, such that a portion of the secondary bolt 240 may be positioned between the primary bolt 230 and the housing 130.

The secondary bolt 240 includes a post 242 operable to engage the cam arm 224, and an engagement end 244 operable to engage the second foot 118. More specifically, the engagement end 244 is configured to be received in the second notch 119, and may have a thickness corresponding to a width of the second notch 119. The secondary bolt 240 may further include an opening 246 and a pin 247 extending through the opening 246. A spring 248 may be positioned in a cavity 139 in the housing 130 and engaged with the pin 247 such that the secondary bolt 240 is biased toward the retracted or unlocking position.

Figure 4:
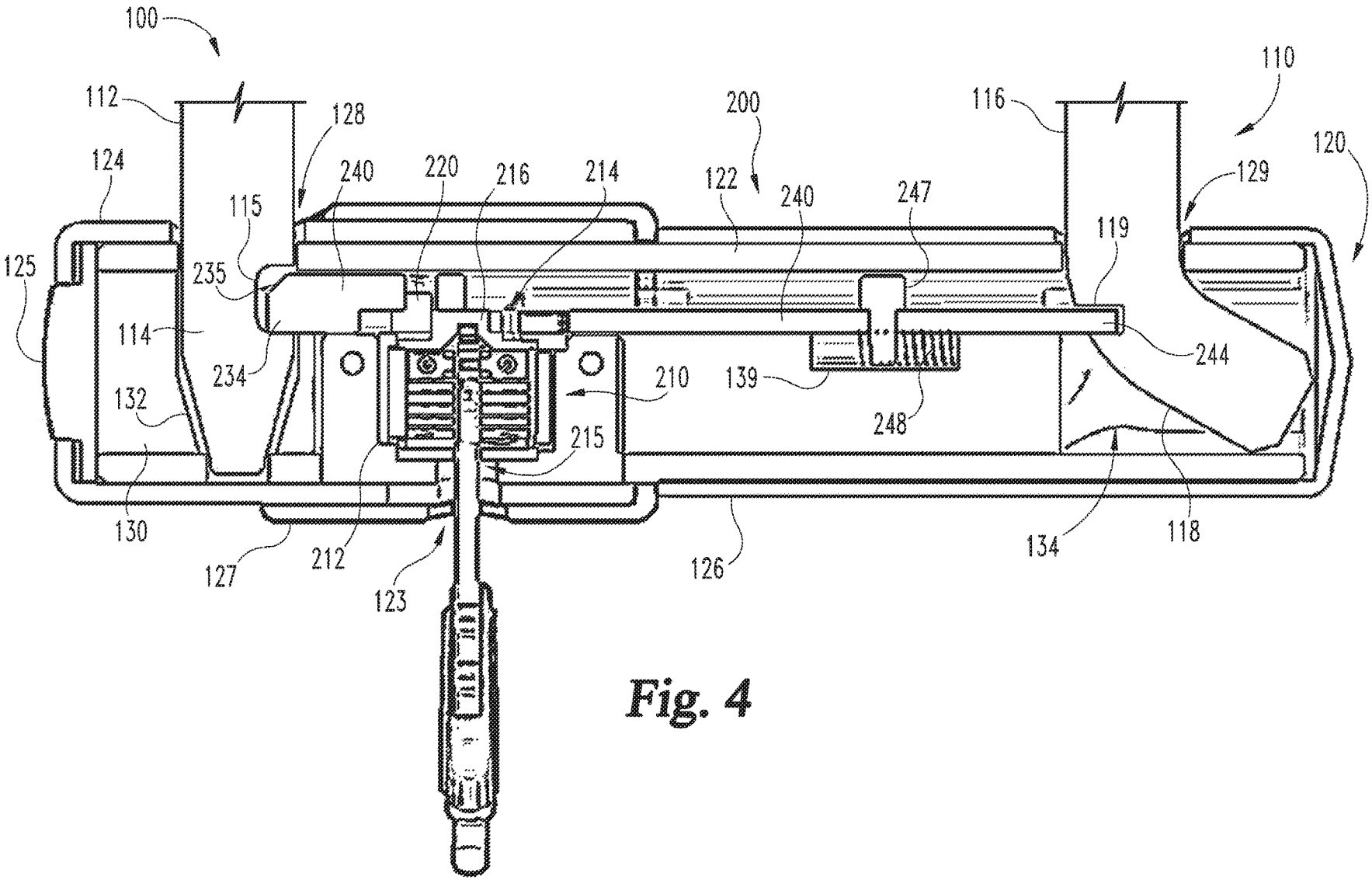
FIG. 4 is a cross-sectional view of the lock in a locked state.
Figure 5:
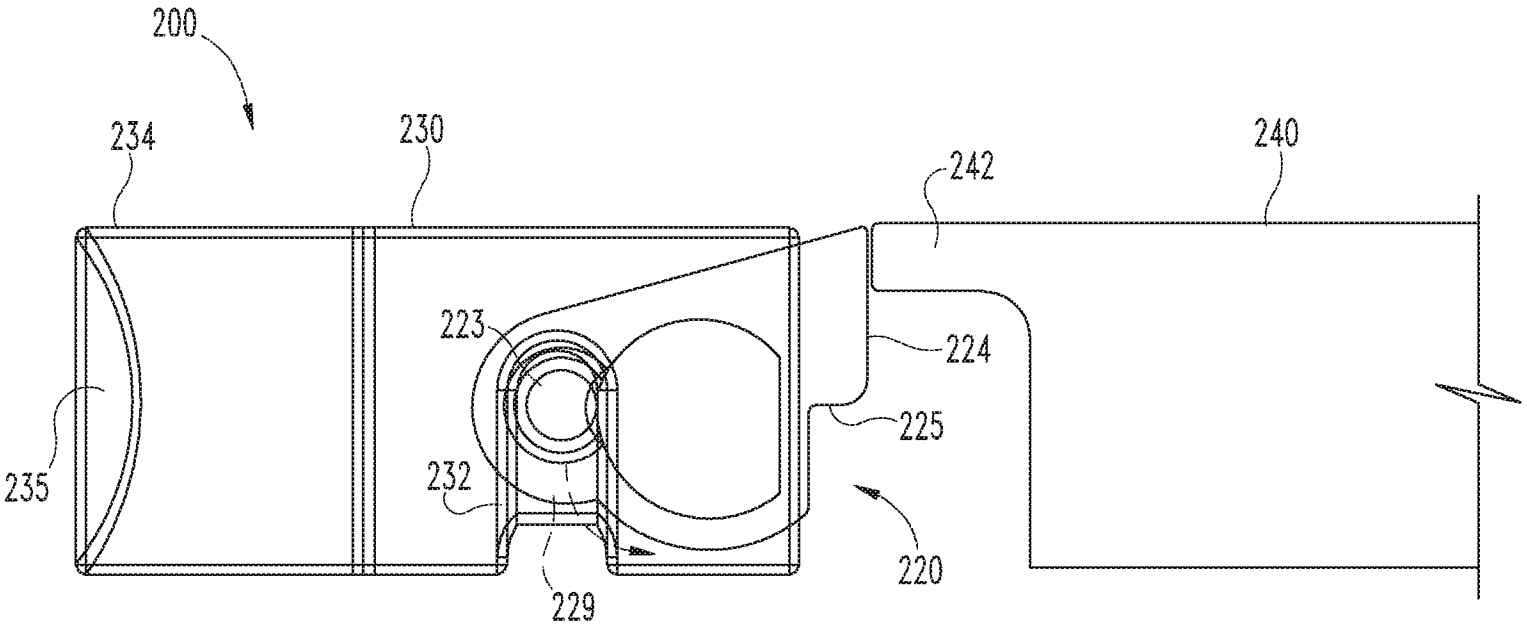
FIG. 5 is an elevational view of the locking subassembly in the locked state.
Figure 6:
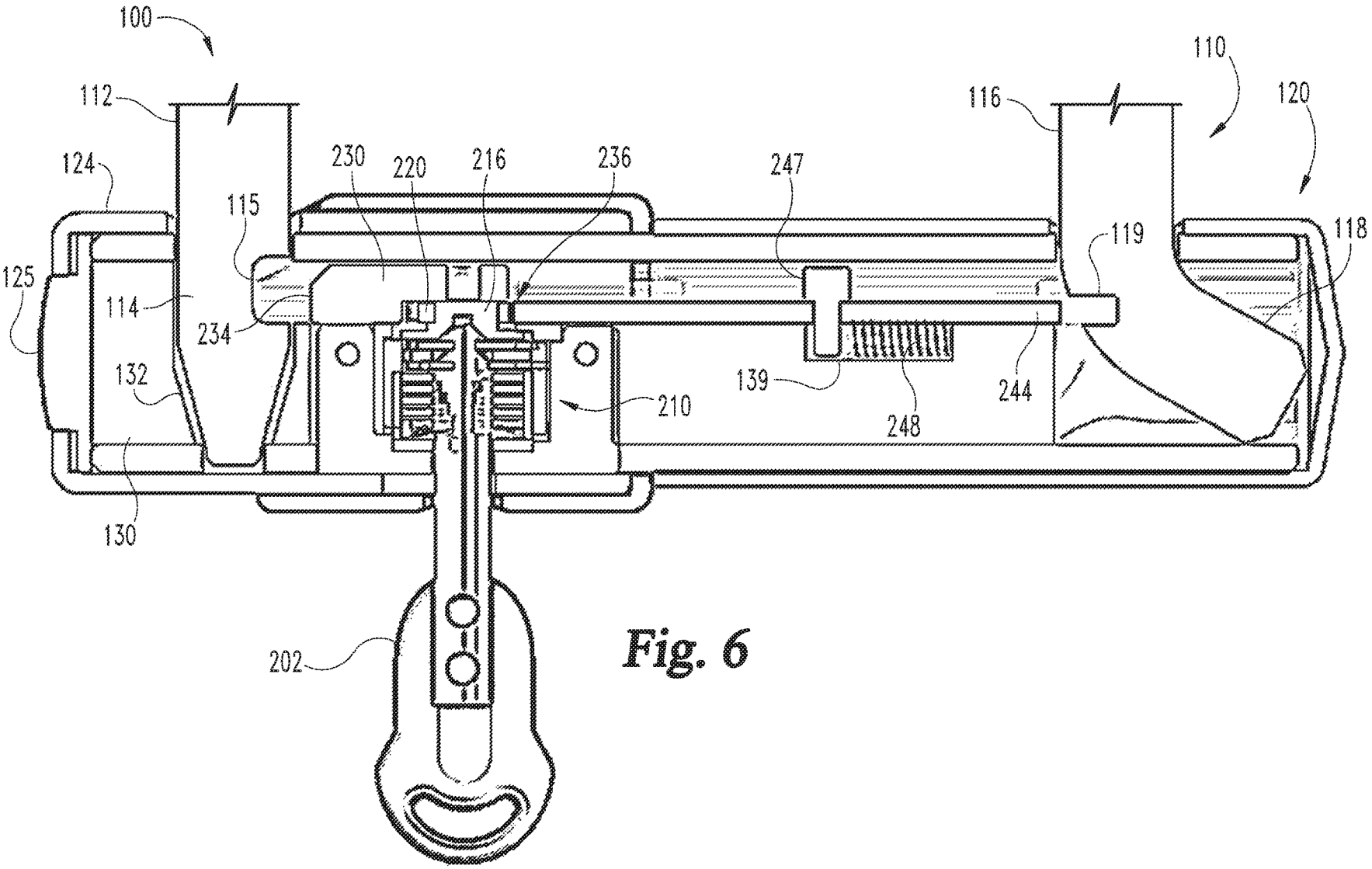
FIG. 6 is a cross-sectional view of the lock in an unlocked state.
Figure 7:
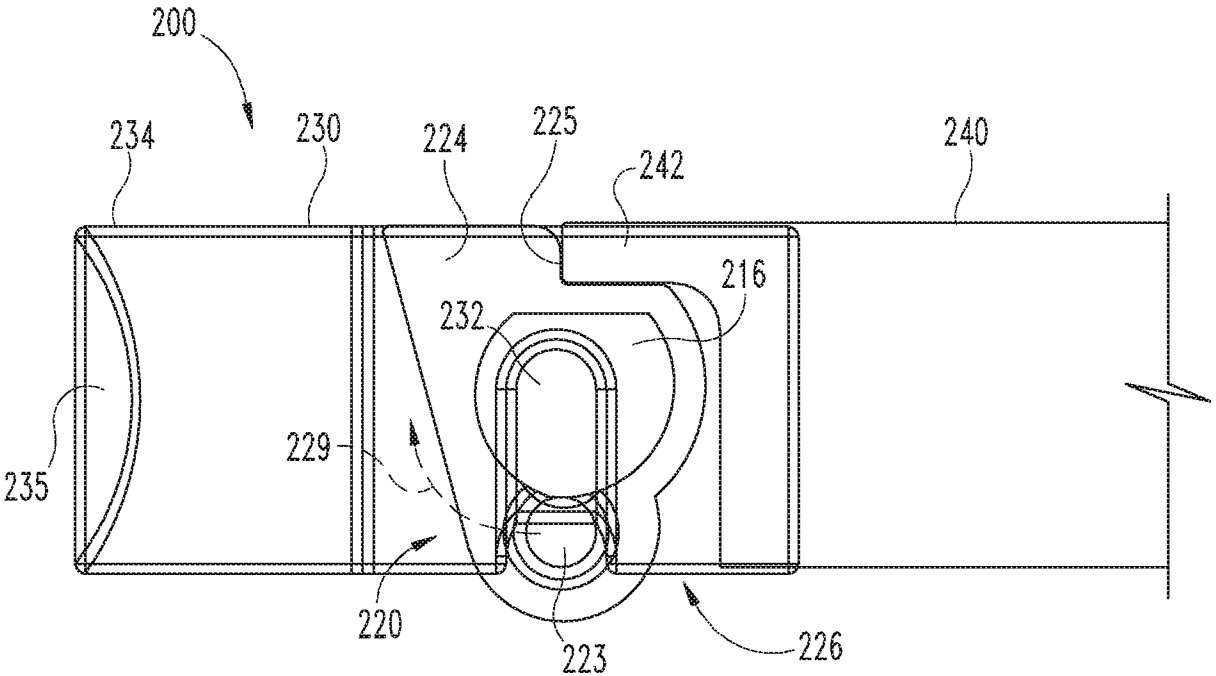
FIG. 7 is an elevational view of the locking subassembly in the unlocked state.

With additional reference to FIGS. 4-7, operation of the exemplary hoop lock 100 will now be described. FIGS. 4 and 5 depict the lock 100 in the locked state, and FIGS. 6 and 7 depict the lock 100 in the unlocked state. More specifically, FIGS. 4 and 6 depict a cross-sectional view of the lock 100, and FIGS. 5 and 7 depict an elevational view of the locking assembly 200.

With specific reference to FIGS. 4 and 5, when the lock 100 is in the locked state, the primary bolt 230 is engaged with the first foot 114, and the secondary bolt 240 is engaged with the second foot 118. More specifically, the primary bolt engagement end 234 is received in the first notch 115, and the secondary bolt engagement end 244 is received in the second notch 119. Engagement between the bolts 230, 240 and the feet 114, 118 securely couples the shackle 110 to the crossbar 120.

In the locked state, if a person were to cut the shackle 110, for example through one of the legs 112, 116 (see cut 109, FIG. 1), each of the feet 114, 118 would remain securely coupled to the crossbar 120. The notches 115, 119 and the bolts 230, 240 may be configured such that each of the legs 112, 116 is independently prevented from rotating about its longitudinal axis. In such forms, even if the shackle 110 is cut as described above, the connecting portion 111 cannot be pivoted to provide an opening through which one of the objects 101, 102 may pass.

The primary foot notch 115 has a first width, the secondary foot notch 119 has a second width, and each of the engagement ends 234, 244 has a thickness corresponding to the width of the notch 115, 119 in which the engagement end is received. The notch 119 in the angled foot 118 may have a lesser width than the notch 115 in the straight foot 114. For example, the angled foot 118 may be pre-stressed due to manufacturing processes, and providing the second notch 119 with a lesser width may improve the structural integrity of the angled foot 118 as compared to if the second notch 119 were to be provided with the same width as the first notch 115.

In the locked state, the cam protrusion 223 is positioned at an end of the primary bolt channel 232, and a radially outer surface of the cam arm 224 is engaged with the secondary bolt post 242. When no key is inserted in the lock cylinder 210, the spindle 214, and thus the cam 220, cannot be rotated. As such, the protrusion 223 and cam arm 224 retain the bolts 230, 240 in extended or locking positions, thereby deadlocking the bolts 230, 240. When a proper key 202 is used to rotate the spindle 214, the spindle extension 216 causes the cam 220 to rotate in an unlocking direction (counter-clockwise in FIG. 5). Rotation of the cam 220 causes the radially offset protrusion 223 to travel along an arcuate path 229, and causes the cam arm 224 to move away from the secondary bolt 240. As the protrusion 223 moves along the path 229, it slides within the channel 232 and retracts the primary bolt 230. As the cam arm 224 moves away from the secondary bolt 240, the spring 248 urges the bolt 240 toward the retracted position.

With specific reference to FIGS. 6 and 7, when the key 202 is fully rotated, the lock 100 is in the unlocked state. In the unlocked state, the bolts 230, 240 are in retracted or unlocking positions, and are disengaged from the feet 112, 116 such that the shackle 110 can be removed from the crossbar 120. In the unlocked state, the cam protrusion 223 is positioned in the primary bolt channel 232 adjacent an edge of the primary bolt 230, and the post 242 abuts a side surface 225 of the cam arm 224. Additionally, the post 242 is positioned within the undercut 236 between the primary bolt 230 and the lock cylinder 210. In other words, when the locking assembly 200 is in the unlocked state, a portion of the primary bolt 230 overlaps a portion of the secondary bolt 240.

When the key 202 is subsequently rotated to transition the locking assembly 200 to the locked state, the cam protrusion 223 travels along the arcuate path 229 in the direction opposite that which it travels during the unlocking operation. (clockwise in FIG. 7), and the cam arm 224 rotates toward the second foot 118. As the protrusion 223 moves along the arcuate path 229, it slides within the channel 232 and extends the primary bolt 230, thereby moving the engagement end 234 into the first notch 115. The engagement end 234 may include a tapered surface or chamfer 235, for example to allow for some misalignment between the engagement end 234 and the notch 115.

As the cam arm 224 rotates toward the second foot 118, the cam arm 224 urges the secondary bolt 240 in the direction of extension, thereby moving the engagement end 244 into the second notch 119. The cam arm 224 may include a rounded corner to provide for a smoother transition as the post 242 travels along the outer surface of the cam 220. As the secondary bolt 240 extends, the spring 248 is compressed between the pin 247 and the side surface of the cavity 139. Additionally, the pin 247 may slide along the inner surface of the tube 122, thereby preventing the secondary bolt 240 from pivoting during extension or retraction. In other words, the pin 247 is positioned partially between the secondary bolt 240 and an inner surface of the tube 122, thereby preventing the secondary bolt 240 from moving toward the inner surface.

As can be seen from the foregoing, the exemplary locking assembly 200 is operable in a locking state and an unlocking state. In the locking state, the bolts 230, 240 engage the feet 114, 118 to secure the shackle 110 to the crossbar 120. In the unlocking state, the bolts 230, 240 are disengaged from the feet 114, 118, and the shackle 110 can be removed from the crossbar 120. Additionally, the state of the locking assembly 200 corresponds to the rotational position of the cam 220. In other words, the locking assembly 200 is operable in the locking state in response to a first rotational position of the cam 220, and is operable in the unlocking state in response to a second rotational position of the cam 220.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock, comprising:

a shackle comprising:

a first leg; and a second leg; and a crossbar comprising:

a cylindrical tube having a first opening configured to receive a first end portion of the first leg, and a second opening configured to receive a second end portion of the second leg; and a locking mechanism operable to engage the first and second end portions to secure the shackle to the crossbar, the locking mechanism comprising a lock cylinder including a keyway;

wherein the lock cylinder is positioned between the first and second openings and is offset from a center location of the crossbar and positioned closer to one of the first and second openings than the other of the first and second openings;

wherein the lock cylinder has a locking state that prevents removal of the shackle from the crossbar, and wherein the lock cylinder has an unlocking state that permits entire removal of the shackle from the crossbar; and wherein the crossbar includes a third opening aligned with the keyway.

2. The lock of claim 1, wherein the first leg is substantially parallel to the second leg, and wherein the keyway is substantially parallel to the first and second legs.

3. The lock of claim 1, wherein the first and second legs of the shackle are arranged parallel with one another.

4. The lock of claim 1, wherein the third opening is positioned longitudinally between the first and second openings.

5. The lock of claim 1, wherein the lock cylinder is positioned nearer the first opening than the second opening.

6. The lock of claim 1, wherein the locking mechanism comprises:

a first bolt operable to engage the first end portion;

a second bolt operable to engage the second end portion; and wherein when the lock cylinder is in the locking state, an engagement portion of the first bolt is received in a first notch in the first end portion, and an engagement portion of the second bolt is received in a second notch in the second end portion;

wherein when the lock cylinder is in the unlocking state, the engagement portions of the first and second bolts are not received in the first and second notches of the first and second end portions; and wherein activation of the lock cylinder simultaneously displaces the first and second bolts relative to the first and second notches, respectively.

7. The lock of claim 6, wherein the first bolt and the second bolt have different lengths.

8. The lock of claim 6, further comprising:

a cam rotationally coupled to the locking mechanism and including a radial arm and an axial protrusion, wherein the axial protrusion is radially offset from a rotational axis of the cam, and wherein the cam is asymmetric about the rotational axis;

a biasing member urging the second bolt toward the cam;

wherein the first bolt includes a channel receiving the axial protrusion;

wherein the second bolt includes a post engaged with the radial arm; and wherein the locking state of the lock cylinder corresponds to a first rotational position of the cam and the unlocking state of the lock cylinder corresponds to a second rotational position of the cam.

9. The lock of claim 8, wherein in the unlocking state, the post is positioned between the first bolt and the lock cylinder.

10. The lock of claim 6, wherein the first notch has a first width, the second notch has a second width less than the first width, the first bolt has a first thickness corresponding to the first width, and the second bolt has a second thickness corresponding to the second width.

11. A hoop lock, comprising:

a shackle including a first leg and a second leg, and wherein the first leg includes a first end portion and the second leg includes a second end portion;

a crossbar comprising a cylindrical tube including a first opening configured to receive the first end portion, a second opening configured to receive the second end portion, and a third opening positioned between the first and second openings; and a locking assembly in the crossbar, the locking assembly comprising a lock device positioned in the third opening and offset from a center location of the crossbar and positioned closer to one of the first and second openings than the other of the first and second openings;

wherein the locking assembly has a locking state in which the first and second end portions are secured in the first and second openings in the crossbar; and wherein the locking assembly has an unlocking state in which the first and second end portions are entirely removable from the first and second openings in the crossbar.

12. The hoop lock of claim 11, wherein the lock device is positioned nearer the first end portion than the second end portion.

13. The hoop lock of claim 11, wherein the lock device comprises a lock cylinder configured to permit transitioning between the locking state and the unlocking state.

14. The hoop lock of claim 13, wherein the lock cylinder includes a spindle, wherein the spindle is rotatable in response to insertion of a proper key into the lock cylinder.

15. The hoop lock of claim 11, wherein the locking assembly further comprises:

a first bolt operable to engage the first end portion;

a second bolt operable to engage the second end portion;

wherein an engagement portion of the first bolt is received in a first notch of the first end portion when the locking assembly is in the locking state;

wherein an engagement portion of the second bolt is received in the second notch of the second end portion when the locking assembly is in the locking state;

wherein when the locking assembly is in the unlocking state, the engagement portions of the first and second bolts are not received in the first and second notches of the first and second end portions; and wherein activation of the lock device simultaneously displaces the first and second bolts relative to the first and second notches, respectively.

16. The hoop lock of claim 15, further comprising:

a cam rotationally coupled to the locking device and including a radial arm and an axial protrusion, wherein the axial protrusion is radially offset from a rotational axis of the cam, and wherein the cam is asymmetric about the rotational axis;

a biasing member urging the second bolt toward the cam;

wherein the first bolt includes a channel receiving the axial protrusion;

wherein the second bolt includes a post engaged with the radial arm; and wherein the locking state of the locking assembly corresponds to a first rotational position of the cam and the unlocking state of the locking assembly corresponds to a second rotational position of the cam.

17. The hoop lock of claim 15, wherein the first notch has a first width, the second notch has a second width less than the first width, the first bolt has a first thickness corresponding to the first width, and the second bolt has a second thickness corresponding to the second width.

18. The hoop lock of claim 15, wherein the first bolt and the second bolt have different lengths.

19. A hoop lock, comprising:

a shackle including a first leg and a second leg, wherein the first leg includes a first end portion having a first notch, and wherein the second leg includes a second end portion having a second notch;

a crossbar comprising a cylindrical tube and including a first opening configured to receive the first end portion, a second opening configured to receive the second end portion, and third opening positioned between the first and second openings; and a locking assembly in the crossbar, the locking assembly comprising:

a lock device positioned in the third opening and offset from a center location of the crossbar and positioned closer to one of the first and second openings than the other of the first and second openings;

a first bolt operable to engage the first end portion;

a second bolt operable to engage the second end portion; and wherein the locking assembly has a locking state in which an engagement portion of the first bolt is received in the first notch of the first end portion and in which an engagement portion of the second bolt is received in the second notch of the second end portion; and wherein the locking assembly has an unlocking state in which the engagement portions of the first and second bolts are not received in the first and second notches of the first and second end portions to permit entire removal of the shackle from the crossbar.

20. The hoop lock of claim 19, wherein activation of the lock device simultaneously displaces the first and second bolts relative to the first and second notches, respectively.

21. The lock of claim 1, wherein the cylindrical tube has a cylindrical cross section extending along a longitudinal axis; and wherein the first and second openings extend into the cylindrical tube in a direction transverse to the longitudinal axis.

22. The lock of claim 1, wherein the cylindrical tube has a curved outer surface; and wherein the first and second openings extend through the curved outer surface.

* * * * *